US010517798B2

(12) United States Patent
van Wijngaarden et al.

(10) Patent No.: US 10,517,798 B2
(45) Date of Patent: Dec. 31, 2019

(54) MEDICINE FEEDING CANISTER FOR IN AN AUTOMATED MEDICINE DISPENSING DEVICE

(71) Applicant: Canister Solutions B.V., Driebergen-Rijsenburg (NL)

(72) Inventors: Arie van Wijngaarden, Driebergen-Rijsenburg (NL); Caroline van Wijngaarden, Driebergen-Rijsenburg (NL)

(73) Assignee: Canister Solutions B.V., Driebergen-Rijsenburg (NL)

( * ) Notice: Subject to any disclaimer, the term of this patent is extended or adjusted under 35 U.S.C. 154(b) by 0 days.

(21) Appl. No.: 15/739,955

(22) PCT Filed: Jul. 2, 2015

(86) PCT No.: PCT/NL2015/050485
§ 371 (c)(1),
(2) Date: Dec. 26, 2017

(87) PCT Pub. No.: WO2017/003280
PCT Pub. Date: Jan. 5, 2017

(65) Prior Publication Data
US 2018/0177683 A1 Jun. 28, 2018

(51) Int. Cl.
*A61J 7/00* (2006.01)
*B65D 83/04* (2006.01)
*A61J 1/03* (2006.01)

(52) U.S. Cl.
CPC ..... *A61J 7/0084* (2013.01); *B65D 83/0454* (2013.01); *A61J 1/03* (2013.01)

(58) Field of Classification Search
CPC ... A61J 7/00; A61J 1/03; A61J 7/0084; B65D 83/0454
USPC ..... 221/13
See application file for complete search history.

(56) References Cited

U.S. PATENT DOCUMENTS 3,998,356 A * 12/1976 Christensen ..... A61J 7/0481 221/2
4,809,877 A * 3/1989 Albright ..... A61J 7/0481 221/121
4,811,764 A * 3/1989 McLaughlin ..... A61J 7/0084 141/104

(Continued)

FOREIGN PATENT DOCUMENTS

CA 2820260 A1 12/2014
DE 102014110020 B4 * 5/2016 ..... A61J 1/03

(Continued)

*Primary Examiner* — Rakesh Kumar
(74) *Attorney, Agent, or Firm* — Rudy J. Ng; Bret E. Field; Bozicevic, Field & Francis LLP

(57) ABSTRACT

Medicine feeding canister for in an automated medicine dispensing device, wherein the canister comprises a housing, a storage for storing a plurality of medicine units, a discharge for discharging the medicine units and a feeding mechanism for feeding the stored medicine units to the discharge, wherein the storage comprises a plurality of medicine holders, each of the medicine holders being arranged for holding one medicine unit separated from the other held medicine units, and wherein the feeding mechanism is arranged for feeding the medicine units in the medicine holders to the discharge.

11 Claims, 7 Drawing Sheets

(56) References Cited

U.S. PATENT DOCUMENTS

| | | | | | |
|---|---|---|---|---|---|
| 5,044,516 | A * | 9/1991 | Hoar | A61J 7/0481 | 221/15 |
| 5,441,165 | A * | 8/1995 | Kemp | A61J 7/0084 | 221/102 |
| 5,522,525 | A * | 6/1996 | McLaughlin | A61J 7/0481 | 221/4 |
| 6,766,219 | B1 * | 7/2004 | Hasey | A61J 7/0084 | 221/11 |
| 7,831,336 | B2 * | 11/2010 | Gumpert | A61J 7/0481 | 221/10 |
| 9,443,370 | B2 * | 9/2016 | Carson | G07F 9/006 | |
| 2010/0030374 | A1 * | 2/2010 | Saltsov | A61J 7/0084 | 700/225 |
| 2018/0104153 | A1 * | 4/2018 | Wang | A61J 7/0069 | |
| 2018/0177683 | A1 * | 6/2018 | van Wijngaarden | B65D 83/0454 | |

FOREIGN PATENT DOCUMENTS

| | | | | |
|---|---|---|---|---|
| EP | 2752182 | A1 | 7/2014 | |
| EP | 3009994 | A1 * | 4/2016 | A61J 1/03 |
| GB | 2473433 | A | 3/2011 | |
| WO | WO2013120029 | A1 | 8/2013 | |
| WO | WO2015041229 | A1 | 3/2015 | |

* cited by examiner

MEDICINE FEEDING CANISTER FOR IN AN AUTOMATED MEDICINE DISPENSING DEVICE

The present invention relates to a medicine feeding canister for in an automated medicine dispensing device, wherein the canister comprises a housing, a storage for storing a plurality of medicine units, a discharge for discharging the medicine units and a feeding mechanism for feeding the stored medicine units to the discharge.

An automated medicine dispensing device, also called automated dispensing cabinet (ADC), unit-based cabinets (UBCs), automated dispensing devices (ADDs), automated distribution cabinets or automated dispensing machines (ADMs), is a computerized drug storage and packaging device arranged to pack different types of medicines in accordance with a predetermined patient specific recipe. The automated medicine dispensing device thereto comprises a plurality of medicine feeding canisters, typically from 50 to 400, each containing a different type of medicine.

Such a canister typically comprises a housing which defines a container as storage for storing a plurality of medicine units, for instance in the form of pills, tablets or capsules. Near the bottom of the container, a feeding mechanism is arranged to individually feed the medicine units to a discharge, for instance a discharge opening in the canister. The feeding device is typically in the form of a rotary member having receptacles shaped in accordance with the contained medicine units. Upon rotation of the rotary member, a receptacle will be filled with a single medicine unit and transported, by rotation, to the discharge. It is important that only a single medicine unit fits in the receptacles of the rotary member to ensure that only a single unit is discharged at a time. The discharge of the canister is coupled to transporting means of the dispensing device, for instance a gutter or endless belt, for transporting the discharged medicine unit to a packaging mechanism in the dispensing device.

This feeding mechanism is typically driven by a driving shaft of the automated medicine dispensing device, such that the canister can feed a medicine unit upon engagement of the driving shaft. The medicine canister is hereto provided with a shaft coupling to couple the driving shaft of the automated medicine dispensing machine to the feeding mechanism. To ensure that a medicine unit is fed by the canister, a registration unit, for instance an optical registration unit, is typically provided near the discharge of the canister which determines whether a medicine unit is discharged upon rotation of the driving shaft.

It is a problem that the feeding mechanism in the form of the rotary member is not always reliable. It is for instance possible that a receptacle in the rotary member is not correctly filled and therefore empty, such that upon transfer by rotation of the rotary member, no medicine unit will be discharged. The rotary member can for instance be rotated until a medicine unit is detected by the registration unit.

Another problem of the rotary members is jamming. It is possible that medicine units jam the rotation of the rotary member due to incorrect placement in the receptacle. In order to counter this problem, it is known to reverse the rotation of the rotary member in case a jam is detected, for instance by increased measured torques or decreased measured rational movement of the driving shaft. The driving shaft of the dispensing device is thereto typically arranged to rotate in two opposite directions.

It is further a drawback of known canisters that it is difficult, if not impossible, to reliably dispense odd shaped and/or partial medicine units, i.e. parts of tablets. In particular these parted tablets, for instance tablets broken in half, are susceptible to damage. For instance in the container or in the rotary member upon jamming, these medicine units can be pulverized.

It is therefore known to equip an automated medicine dispensing device with a removable tray provided with a plurality of holders, each arranged to receive and discharge a single and possibly different medicine unit, for instance a part of a tablet. By automatically, in accordance with the patient specific recipe, discharging the medicine unit, for instance by withdrawing the bottom of a holder in the tray, the contents on the holder is fed to a collection part of the automated medicine dispensing device position under the tray. Filling, and in particular subsequently checking of the filling, of such a tray is labour intensive and time consuming operation as each specific medicine holder needs to be manually filled with the specific medicine in accordance with the recipes to be processed.

It is a goal, amongst other goals, of the present invention to provide an improved canister wherein at least one of the above mentioned problems is at least partially solved.

In order to meet this goal, amongst other goals, the canister according to the preamble is characterised in that the storage comprises a plurality of medicine holders, each of the medicine holders being arranged for holding one medicine unit and wherein the feeding mechanism is arranged for feeding the medicine units in the medicine holders to the discharge. By holding a medicine unit in a medicine holder, and preferably separated from the other held medicine units, damage to the medicine units by mutual contact in the storage is prevented, as is common in conventional canisters having a shard container for the medicine units. This allows using a canister to supply medicine units in an automated medicine dispensing device for which a removable tray is now used as mentioned above. The canister is therefore shaped and configured to be inserted in to an automated medicine dispensing device Preferably one type of medicine is stored in the medicine holders of a canister, such that on demand, for instance by driving the driving shaft of the automated medicine dispensing device as mentioned above which is preferably operably connectable to the feeding mechanism, the medicine units in the medicine holders are fed to the discharge, preferably in a separated manner from the other medicine units.

The term medicine unit preferably comprise a single part of a medicine, i.e. a pill, tablet or a capsule or a part thereof. It may however also be possible that a medicine holder in accordance with the invention is used to contain a combination of, preferably frequently used combinations of, medicines, such that a holder may contain a plurality of a pills, tablets or capsules or parts thereof.

Although it is possible that a separate feeding mechanism is provided to transport the medicine units from the respective holders to the discharge, it is preferred if the medicine holders are movable for feeding the medicine units to the discharge. The medicine units are hereby transported in their respective medicine holders, such that further damage to the medicine units is prevented. The medicine holders are preferably movable with respect to the discharge, such that the medicine holders are movable towards the discharge for discharging the medicine held in the medicine holder when the medicine holder is aligned with, or is close to, the discharge. The problem of jamming associated with the rotary member as mentioned above is then prevented, as the medicine units are already contained in their respective medicine holders.

Preferably, the medicine holders are movable in a rotating manner. The medicine holders are hereby moved successively in operable contact with the discharge upon movement, such that the medicine units held in the respective medicine holders are successively discharged through the discharge. The medicine holders may for instance be formed as a carrousel or rotating buffer comprising a plurality of medicine holders, wherein the different medicine holders are successively aligned with the discharge for discharging the medicine units held in the respective medicine holders.

An improved protection to the medicine units is obtained if according to a further preferred embodiment the medicine holders comprise compartments, wherein each of the compartments is arranged for holding one medicine unit. The compartments are preferably arranged to separate the respective medicine units from each other, for instance using suitable dividing means such as walls.

According to a further preferred embodiment, the storage comprises at least one holding surface for holding thereon a plurality of medicine units. By storing the medicine units on a holding surface, in contrast to a container or box shaped storage according to the prior art, the respective medicine units can be held in separated manner from each other, for instance by holding the medicine units at mutual distances from each other. This prevents or at least reduces damage due to mutual contact between the medicine units.

It is hereby preferred if the discharge is formed as an opening in the holding surface. Movement of the medicine units on the holding surface towards the opening will then discharge the medicine units held in the medicine holder.

Although it is possible that the holding surface itself is formed as transportation or feeding means, for instance in the form of transporting belt or conveyer means for transporting the held medicine units to the discharge, for instance in the form of the opening as mentioned above, it is preferred if the canister comprises a plurality of movable walls, wherein a compartment is defined by the holding surface and between two adjacent walls. The walls are hereby moved by a for instance by suitable driving means while the holding surface remains stationary, thereby moving the held medicine units with respect to holding surface, for instance towards an opening in the holding surface as discharge. The holding surface may hereby define the lower wall or bottom of a compartment. A compartment may further be defined between a housing, for instance enclosed and surrounding the holding surface.

According to a preferred embodiment, the canister comprises a drivable endless belt for driving the medicine holders. This results in a synchronous movement of the medicine holders. Preferably, the endless belt is provided with the plurality of walls. The walls for instance protrude from the surface of the belt, preferably orthogonally, such that the endless belt and two walls at least partially define a compartment, preferably also together with the holding surface as mentioned and possibly a housing.

According to a further preferred embodiment, the medicine holders are arranged to be moved in a loop around the holding surface. This results in an efficient movement of the medicine holders. The holding surface preferably defines a substantially elliptical or circular transport path, or at least a transport path having rounded corners to ensure proper guidance of the medicine units around said corners. The holding surface is thereto preferably shaped, i.e. has a circumferential shape, in accordance with said transport path and may be delimited or enclosed by a housing, wherein the housing delimits the transport path, i.e. the outer surface thereof. Preferably, the medicine holders are moved around the holding surface with respect to an opening therein, wherein the opening may function as a discharge.

In order to increase the capacity of the canister according to the invention, a further preferred embodiment of the canister comprises a plurality of holding surfaces for holding a plurality of layers of medicine units. The holding surfaces are preferably arranged above each other in a stacked orientation. As the discharge of the canister preferably extends at the lower side of the canister, it is preferred if the medicine units can be transported towards the lower side of the canister. Therefore, it is preferred if each of the holding surfaces comprises an opening for transporting a medicine unit from said holding surface to a lower layer, for instance lower holding surface. Moving a medicine unit above an opening in a holding surface, for instance using the movable compartments at least partially defined by the movable walls as mentioned above, will result in the medicine unit falling down to a lower layer as the holding surface in that embodiment preferably forms the lower wall or bottom of the compartment. Therefore, according to a further preferred embodiment, each of the holding surfaces comprises comprise a plurality of movable medicine holders which are movable with respect to the respective opening for feeding the medicine units to said opening. In the lowest holding surface, the opening may form or may at least be connected or associated with the discharge for discharging the medicine unit.

According to a further preferred embodiment, the openings in two subsequent layers are staggered. This will result in a medicine unit falling from one of the holding surfaces to the holding surfaces positioned under this holding surface. A medicine unit will thus be transported from the top holding surfaces, preferably via each lower holding surface, to the lower part which preferably comprises the discharge. It is hereby preferred if an opening in a upper holding surface extends upstream, seen in a predetermined moving direction of the medicine holders, with respect to the opening in said holding surface. The medicine unit will then be transported when fallen on to the holding surface along the moving direction towards the opening in said holding surface.

As said, it is preferred if the medicine holders move in a loop or rotating manner over the holding surface in a predetermined direction. It is then preferred if the opening of an upper holding surface extends next, preferably with a distance corresponding to the width of medicine holder to, an opening of the lower holding surface in a direction opposite the predetermined direction. A medicine unit will then fall onto a holding surface next to the opening in said holding surface, wherein the medicine unit is subsequently moved in a direction away from said opening, to finally arrive at said opening due to the loop or rotating manner of movement of the medicine holders. This maximizes the buffering capacity of the holding surfaces.

According to a further preferred embodiment, the canister comprises a central driving shaft for synchronously moving the medicine holders in each of the holding surfaces in a predetermined direction. This results in an efficient feeding mechanism, wherein the medicine holders on each of the holding surfaces are preferably moved in sync. It is hereby preferred if the openings in the respective layers are staggered in a direction opposite to a moving direction of the medicine holders for forming a spiralling transport path of the medicine units from the upper transporting surface to the discharge. It is then preferred if the canister comprises a plurality of belts arranged between the holding surfaces, the plurality of belts being drivable by the driving shaft.

In order to ensure that the medicine holders are always moved in the same direction, in order to prevent medicine units to directly, i.e. after a single movement of the medicine holders, to fall from one surface to another surface, it is preferred if the canister comprises a transfer mechanism to ensure a predetermined rotation direction for the driving shaft. As mentioned above, an automated medicine dispensing device is typically provided with a driving shaft which rotates in two directions to prevent jamming. The transfer mechanism then ensures that a constant, i.e. unidirectional, rotating movement is applied to the medicine holders, more specifically the driving shaft for moving the plurality of medicine holders, for instance using the belts as mentioned above. More specifically, a further preferred embodiment comprises a shaft coupling for receiving a rotatable driving shaft of an automated medicine dispensing device, wherein the shaft coupling is operably coupled to a driving shaft for moving the plurality of medicine holders via a transfer mechanism, wherein the transfer mechanism is arranged for rotating the driving shaft in a predetermined direction, regardless of the direction of rotation of the shaft coupling.

The invention further relates to a storage for use in a canister according to the invention, wherein the storage comprises a plurality of holding surfaces and movable medicine holders.

The invention further relates to an automated medicine dispensing device provided with a canister according to the invention. The invention furthermore relates to a method for dispensing medicines using a canister or an automated medicine dispensing device according to the invention.

The present invention is further illustrated by the following Figures, which show a preferred embodiment of the canister according to the invention, and are not intended to limit the scope of the invention in any way, wherein:

FIG. 1 schematically shows the canister according to the invention;

FIG. 2 schematically shows several parts of the canister;

FIG. 3 schematically shows the storage unit according to the invention;

Figure 7A:
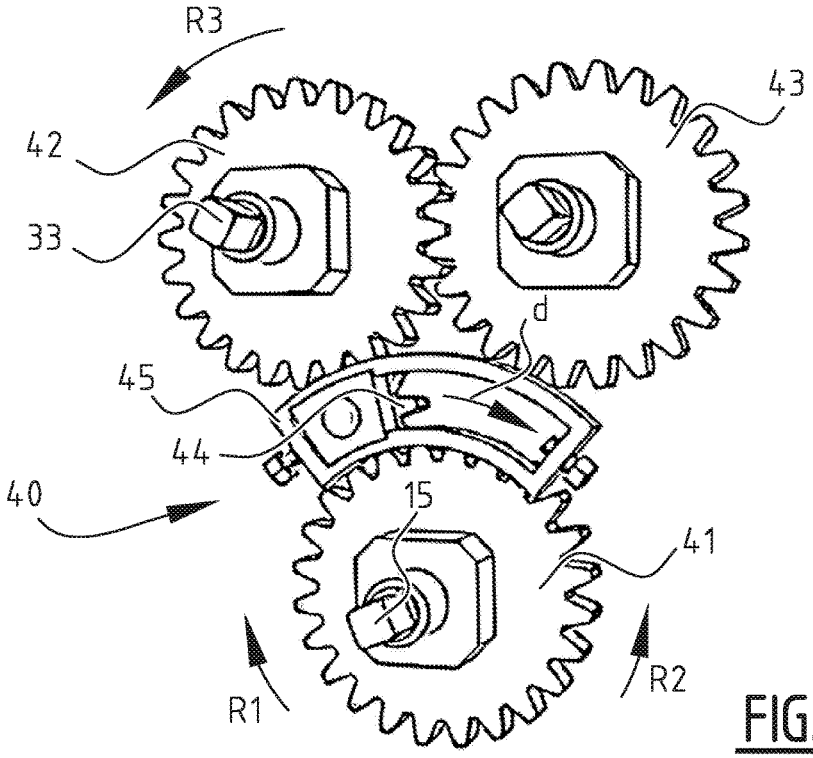
Figure 7B:
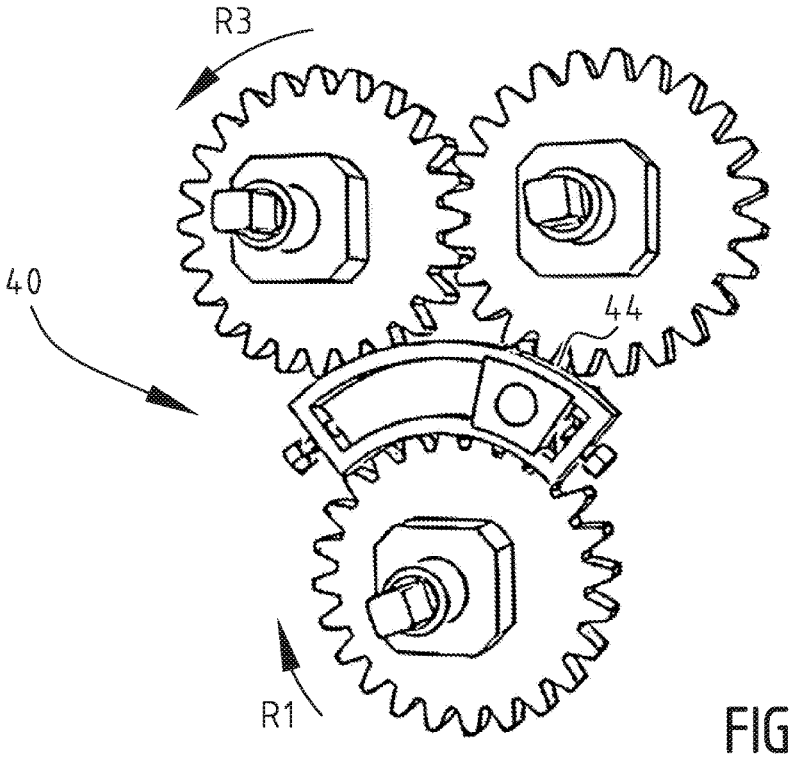

FIGS. 7*a* and 7*b* schematically show the transfer mechanism in two positions for the driving shaft.

Figure 1:
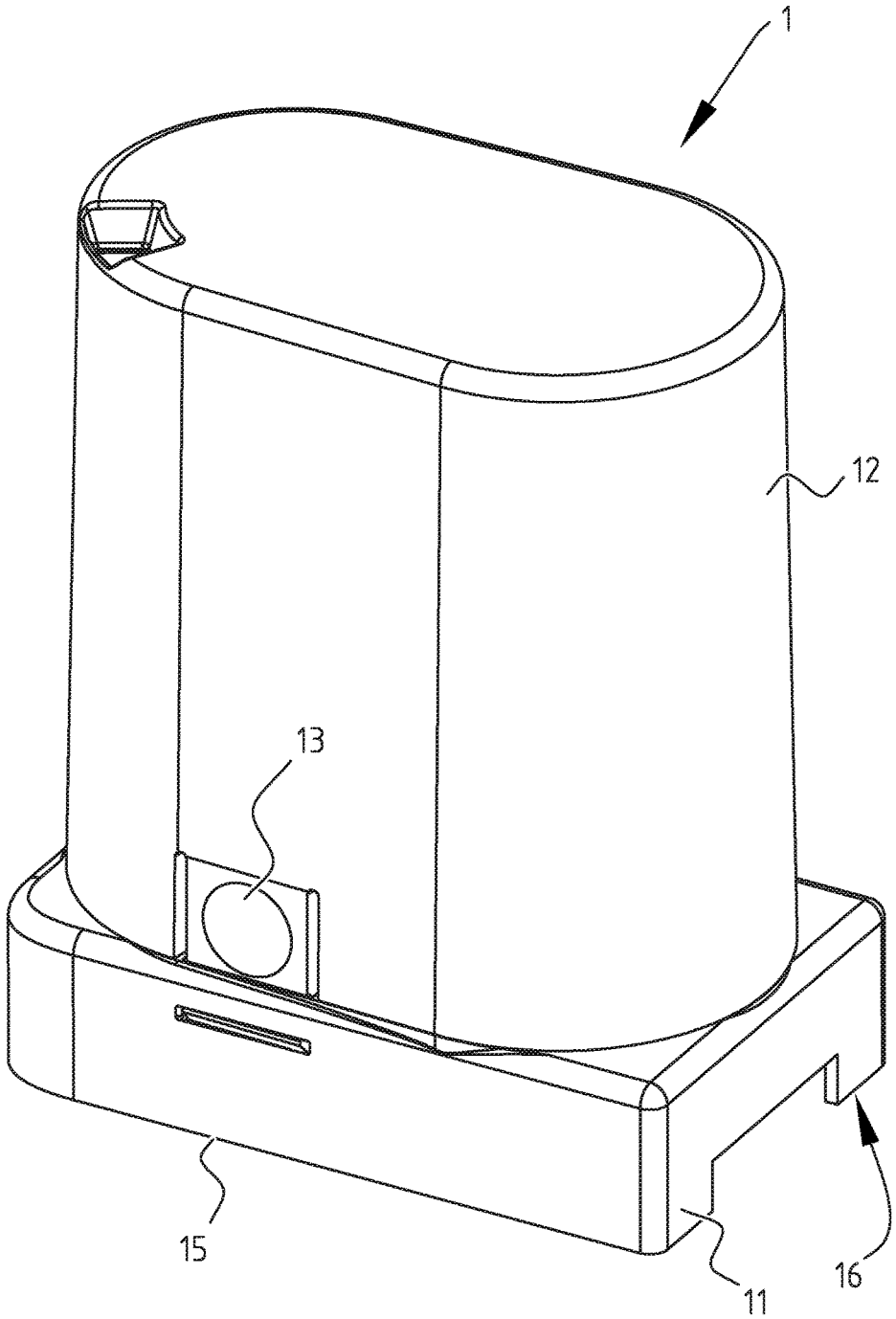
Figure 2:
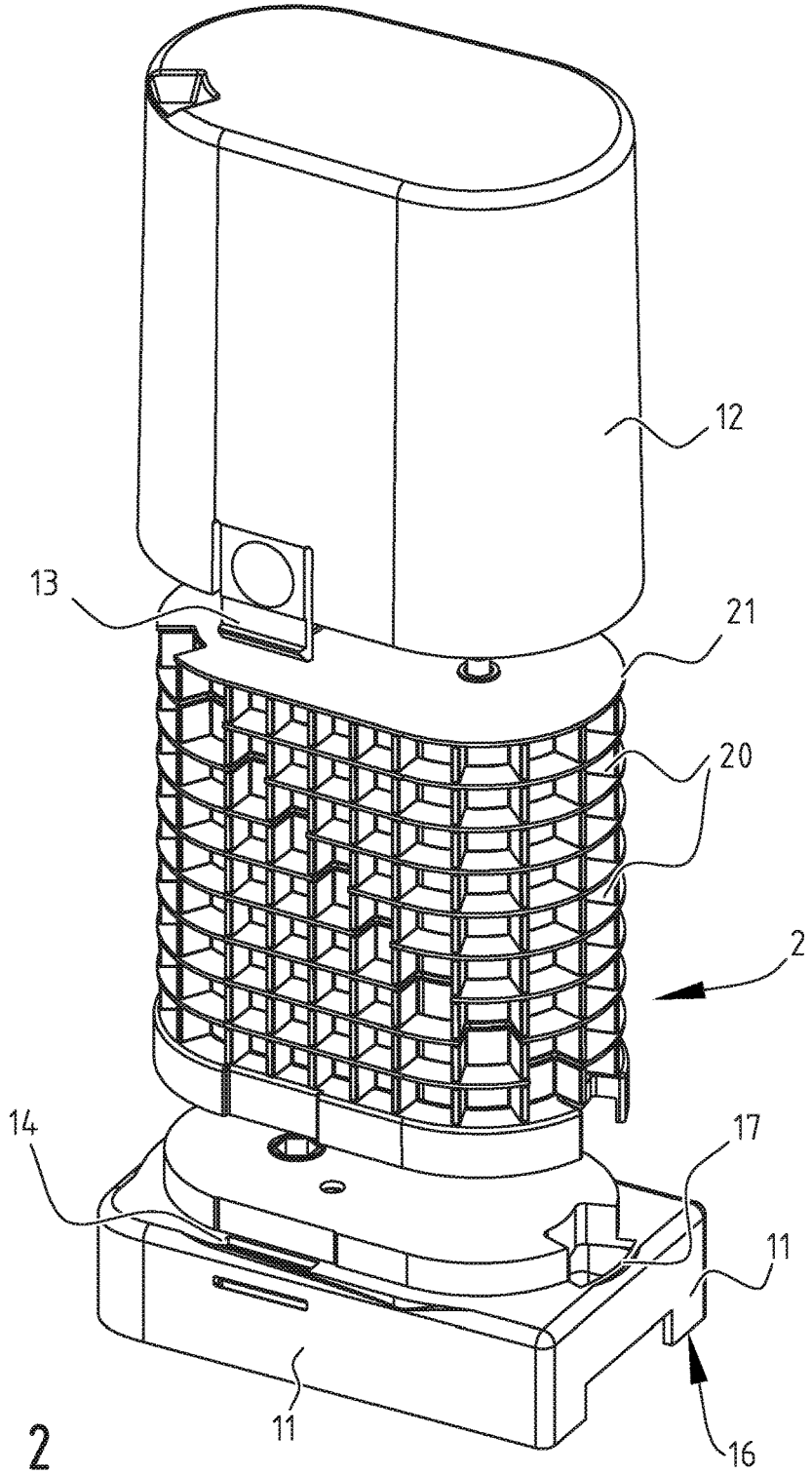

In FIGS. 1 and 2, a canister 1 according to the invention is shown. The canister comprises a base part 11 which is provided with a shaft coupling 15 (not visible) for coupling with a driving shaft of an automated dispensing device. The underside of the base part 11 is further provided with an opening 16 which functions as a discharge for discharging medicines upon rotation of the shaft coupling 15. The opening 16 is operably connected, or in communication with an opening 17 in the upper surface of the base part 11. The canister 1 is further provided with a housing 12 which is removably connected to the base part 11 using clicking tongues 13 which are received in correspondingly shaped openings 14.

The housing 12 encloses a storage unit 2 which is arranged to store a plurality of medicine units, preferably of the same type. The storage unit 2 is hereto provided with a plurality of medicine holders 20 which are arranged to store the respective medicine units in a separated manner, i.e. such that the medicine units do not come into contact with each other. The storage unit, or feeding mechanism, 2 is arranged to discharge medicine units as stored in the medicine holders 20 to the discharge 16, in this example via the opening 17 in the base part 11.

Figure 3:
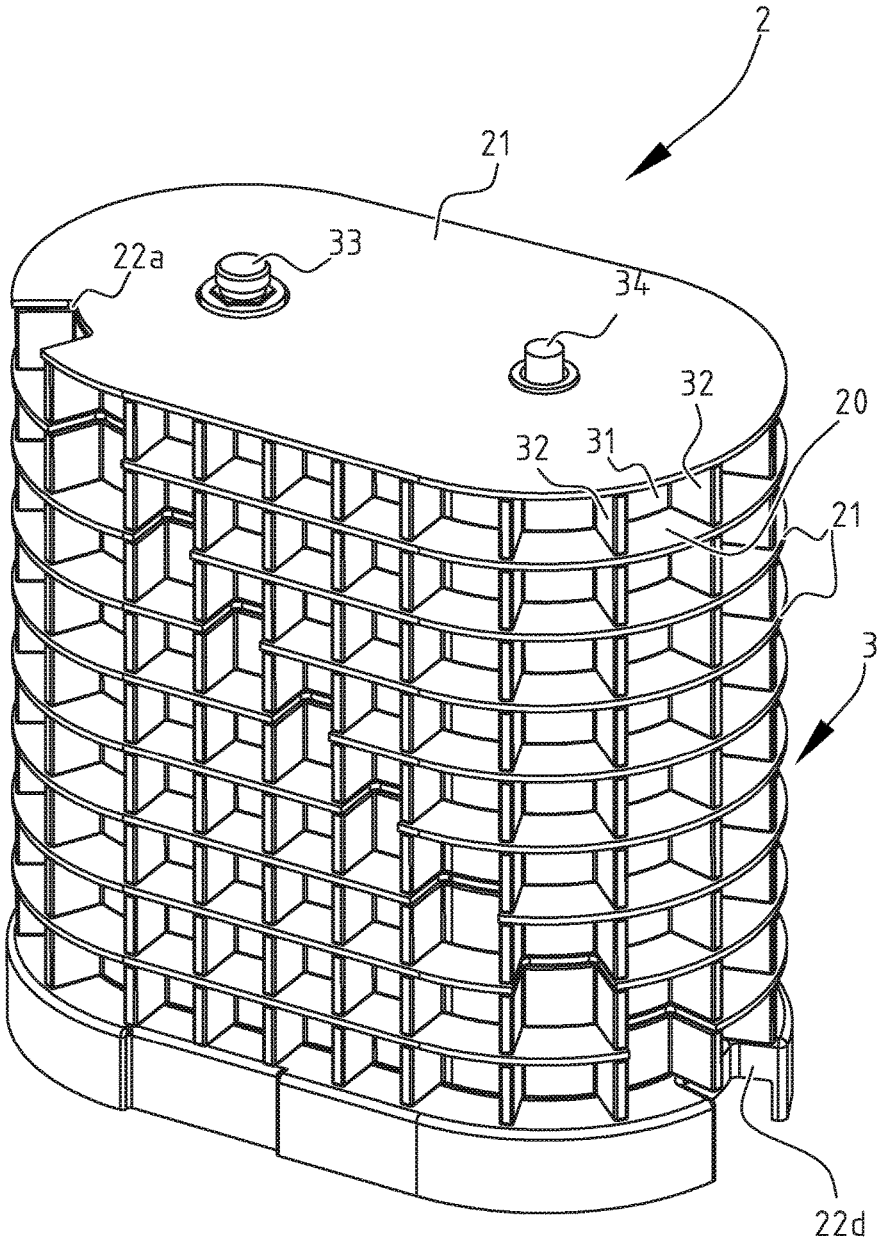
Figure 4:
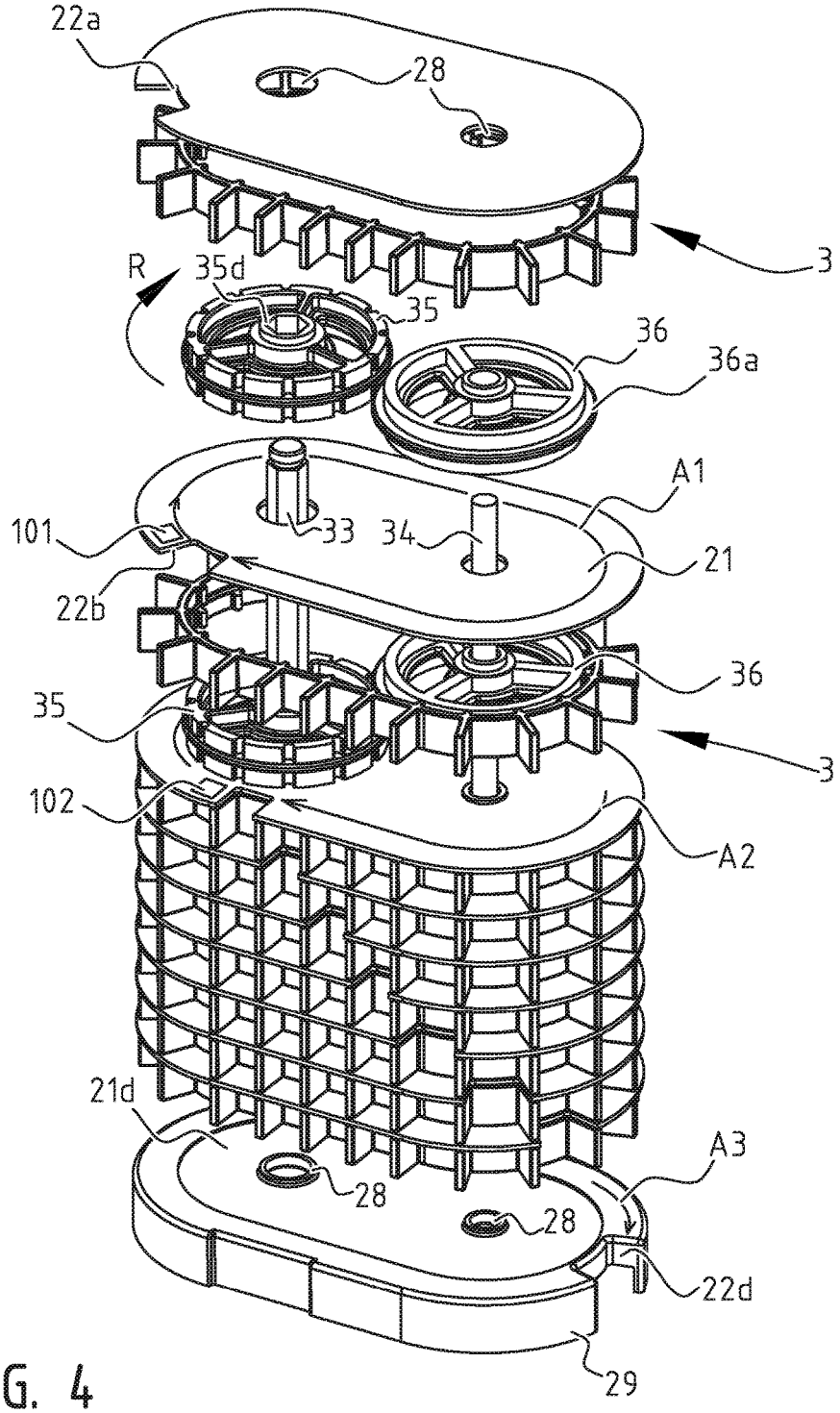
FIG. 4 shows the storage unit of FIG. 3 in exploded view.
Figure 5:
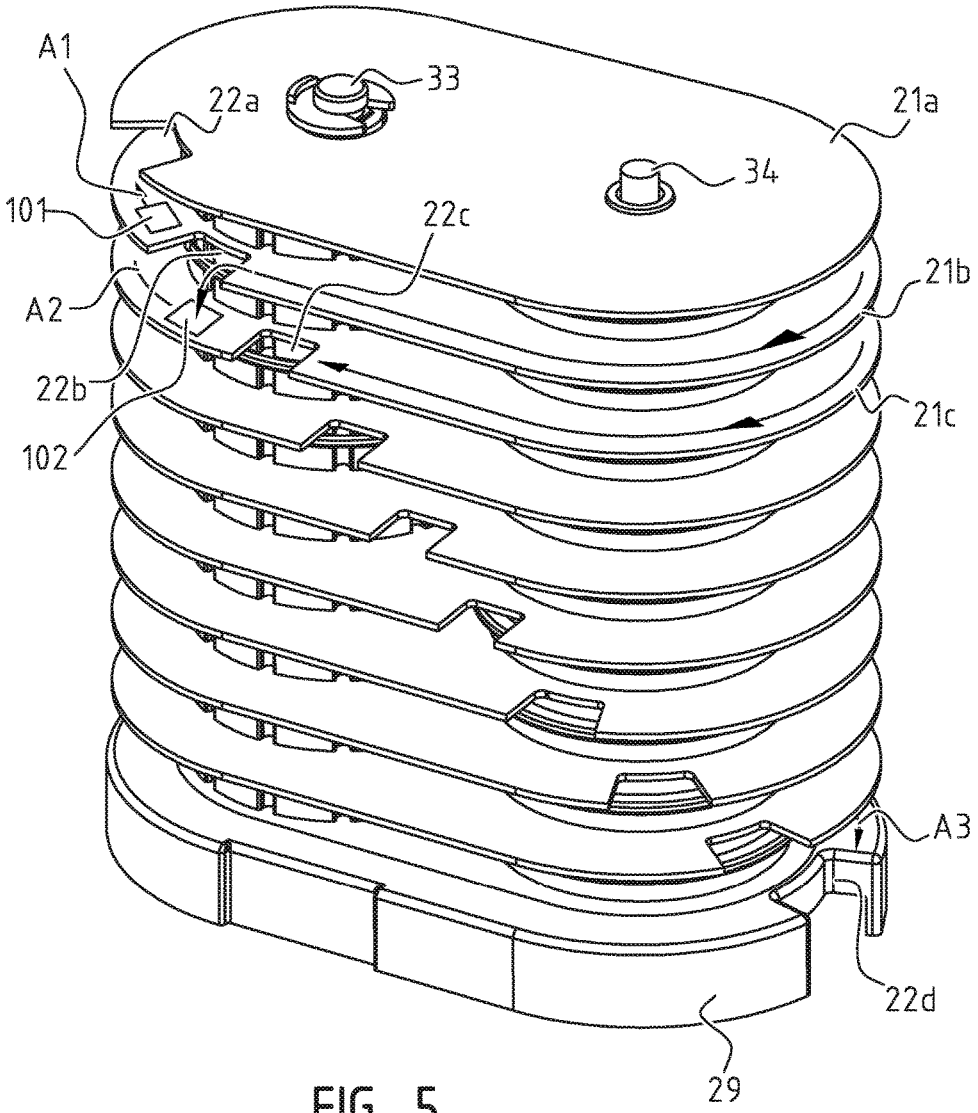
FIG. 5 shows the holding plates of the storage unit.

FIGS. 3-5 show the storage unit 2 in greater detail. The storage unit 2 comprises a plurality of plates 21 which are arranged in a stacked manner, wherein two plates 21 extend at mutual distance for storing medicines there between. The medicines hereby rest on the plates, or holding surfaces, 21. Arranged between the plates 21 are belts 3 which are arranged to move the medicines on the plates 21.

Figure 6:
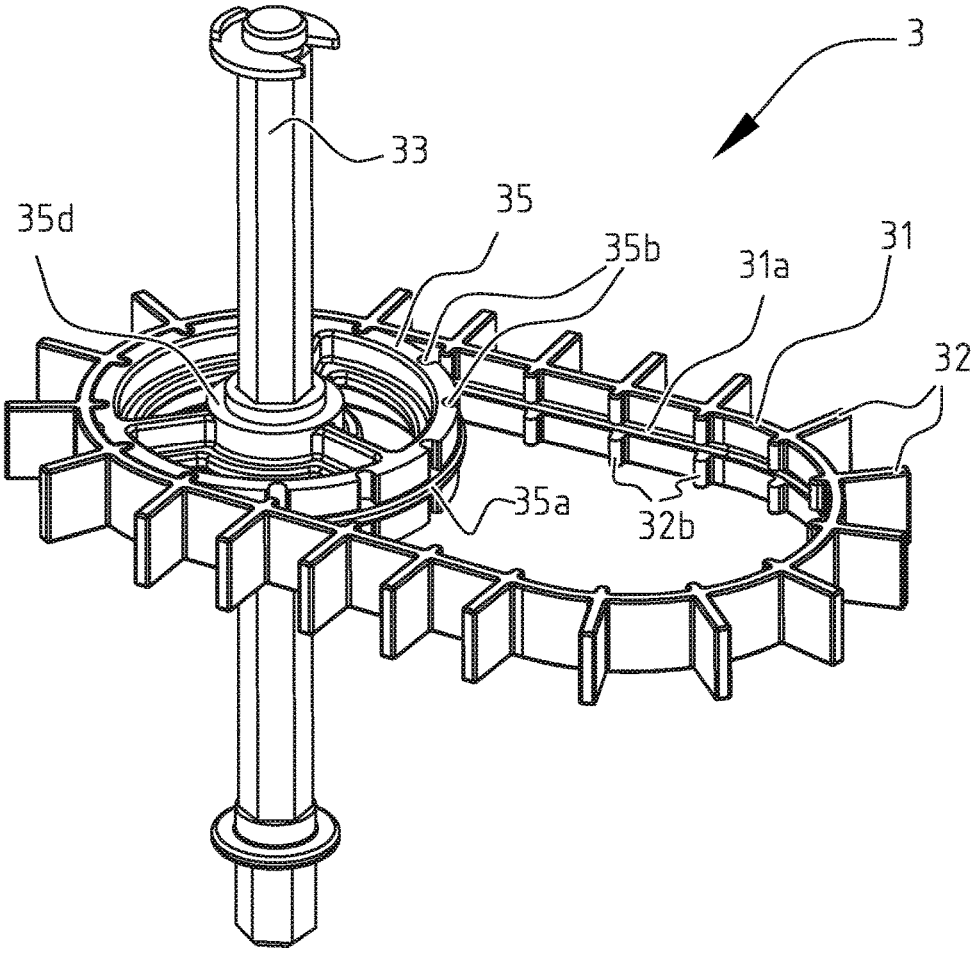
FIG. 6 shows the belt for moving the medicines in isolation.

With reference to FIG. 6, a belt 3 is provided with a belt body 31 formed in a loop on which a plurality of walls 32 is provided. The walls 32 extend substantially orthogonally with respect to the belt body 31. Upon rotation of the belts 3, as will be explained in greater detail below, the walls 32 push the medicines held on the plates 21. A medicine holder 20 is hereby formed as a compartment, see FIG. 3, delimited by walls 32, the belt body 31, two plates 21 and the housing 12 in connected state.

In order to rotate the belts 3, a driving shaft 33 is provided which can be operatively coupled to the shaft coupling 15 as mentioned above. Provided in the driving shaft 33 are a plurality of driving pulleys or sprockets 35 which are provided with an noncircular opening 35*d* for receiving the correspondingly shaped noncircular shape of the driving shaft 33. The outer circumference of the driving sprocket 35 is provided with a bevelled edge 35*a* which is received in a correspondingly shaped groove 31*a* of the belt body 31. This ensures the vertical alignment of the sprocket 35 and the belt body 31. The outer circumference is further provided with vertically oriented grooves 35*b* which receive protruding parts 32*b* of the walls 32. This prevents slip between the sprocket 35 and the belt body 31. The storage unit 2 is further provided with a supporting shaft 34 also provided with a pulley or wheel 36, wherein the belt 3 is tensioned around the two pulleys 35 and 36. Shaft 34 is bearing mounted in the storage unit 2 as is allowed to rotate freely. Also the supporting wheel 36 is provided with a bevelled edge 36*a*. Each of the plates 21 is provided with two holes 28 (see FIG. 4) through which the shafts 33 and 34 extend. Also a base 29 of the storage unit 2 is provided with two holes for receiving therein the shafts 33 and 34.

The base 29 is provided with the lower plate 21*d* which is provided with an opening 22*d* for communicating with the opening 17 of the base part 11. Therefore, in the following, the opening 22*d* will also be referred to as the discharge 22*d*, as this opening 22*d* is in communication with, al least in the connected state, with the discharge 16 of the canister 1 (see FIG. 1).

With specific reference to FIGS. 4 and 5, each of the plates 21 is provided with an opening 22. The opening 22*a* of the upper plate 21*a* is used as filling opening, while the remaining openings between plates 21 are used to transport medicines from an upper plate 21*b* to lower plate, or lower layer, 21*c*. The openings 22 are staggered with respect to each other, seen in a direction of movement R as indicated with the arrow R in FIG. 4. That is; the belts 3 between the plates 21 are driven in a direction indicated with A1 and A2 in FIGS. 4 and 5, wherein the an opening 22*b* of a lower plate, or lower layer, 21*b* is located in a direction opposite the movement direction A1 of the compartments with respect to the opening in an upper plate 21*a*. If a medicine unit is inserted into opening 22*a* of the top plate 21*a*, the medicine will fall onto location 101, which location corresponds to the location of the opening 22*a*, seen in projection. The unit 2 is designed such that the walls 32 only move in the direction indicated with A1, such that the medicine will be moved around the perimeter of the plate 21*b* to finally arrive at the opening 22*b*. This will result in the medicine falling onto the location 102 on the lower plate 21*c*, which location corresponds to the location of the opening 22*b* of the—now upper plate 21*b*. Engagement of the shaft 33 will then result in the movement of the medicine along path A2, to finally fall down on the even lower plate, until the medicine is on the final plate 21*d* and driven into the discharge 22*d*. This arrangement provides a spiralling or cork screw shaped transport path A1 A2 A3 of the medicine units from the first location 101 towards the discharge 22*d*.

As the shaft 33 is driven in a stepwise manner, each rotation of the shaft 33 will result in each of the medicines held in the compartments to move up one spot in the spiralling buffer. This allows an efficient and controlled way of discharging the medicines, without the medicines coming into contact with each other.

In order to ensure that belts 3 are always driven in the same direction, regardless of the direction of rotation of the shaft coupling 15, a transfer mechanism 40 (see FIGS. 7*a* and 7*b*) is provided. This transfer mechanism 40 is incorporated in the base part 11. The mechanism 40 comprises three sprockets 41, 42, 43 with fixed axles and a movable sprocket 45 which is guided in a guide 44. The shaft coupling 15 is coupled to sprocket 41 and the driving shaft 33 is coupled to the sprocket 42. The auxiliary sprocket 43 is in engagement with the sprocket 42. The sprocket 45 is movable between a position in engagement with sprockets 41 and 42, seen in FIG. 7*a*, and a position in engagement with sprockets 41 and 43. The guide 45 is hereby arranged to guide the sprocket 44 between the two positions.

If sprocket 41 is rotated in direction R2 (FIG. 7*a*), the sprocket 45 will remain in the position as shown in FIG. 7*a*. The sprocket 42 will thus rotate in the direction R3. If the sprocket 41 is then however rotated in direction R1, the sprocket 44 will be urged due to the rotational movement in a direction d via guide 45, thereby moving to the position of FIG. 7*b*. The sprocket 44 is now in engagement with sprockets 41 and 43. This will thus still result in a rotation of sprocket 42 in a direction R3 due to the use of auxiliary sprocket 43.

The present invention is not limited to the embodiment shown, but extends also to other embodiments falling within the scope of the appended claims.

The invention claimed is:

1. A medicine feeding canister, wherein the canister comprises a housing, a storage for storing a plurality of medicine units, a discharge for discharging the medicine units and a feeding mechanism for feeding the stored medicine units to the discharge, the storage comprises a plurality of medicine holders, each of the medicine holders being arranged for holding one medicine unit separated from the other held medicine units, and wherein the feeding mechanism is arranged for feeding the medicine units in the medicine holders to the discharge, wherein the medicine holders are movable, in particular with respect to the discharge, for feeding the medicine units to the discharge, wherein the medicine feeding canister comprises a plurality of stacked holding surfaces for holding a plurality of layers of medicine units, wherein each of the holding surfaces comprises an opening for transporting a medicine unit from said holding surface to a lower layer, wherein the openings in two subsequent layers are staggered in the horizontal direction and wherein the opening in the lowest holding surface forms the discharge.

2. The medicine feeding canister according to claim 1, wherein the medicine holders are movable in a rotating manner, in particular with respect to the discharge.

3. The medicine feeding canister according to claim 2, wherein the medicine holders are arranged to be moved in a loop around the holding surface.

4. The medicine feeding canister according to claim 2, wherein the medicine holders comprise compartments, wherein each of the compartments is arranged for holding one medicine unit.

5. The medicine feeding canister according to claim 2, comprising a plurality of movable walls, wherein a compartment is defined by the holding surface and between two adjacent walls and possibly the housing.

6. The medicine feeding canister according to claim 5, comprising a drivable endless belt provided with the plurality of movable walls.

7. The medicine feeding canister according to claim 6, comprising a plurality of belts arranged between the holding surfaces, the plurality of belts being drivable by the driving shaft.

8. The medicine feeding canister according to claim 1, wherein each of the holding surfaces comprises comprise a plurality of movable medicine holders which are movable with respect to the respective opening for feeding the medicine units to said opening.

9. The medicine feeding canister according to claim 8, comprising a central driving shaft for synchronously moving the medicine holders in each of the holding surfaces in a predetermined direction.

10. The medicine feeding canister according to claim 1, wherein the openings in the respective layers are staggered in a direction opposite to a moving direction of the medicine holders for forming a spiralling transport path of the medicine units from an upper transporting surface to the discharge.

11. The medicine feeding canister according to claim 1, further comprising a shaft coupling for receiving a rotatable driving shaft, wherein the shaft coupling is operably coupled to a driving shaft for moving the plurality of medicine holders via a transfer mechanism, wherein the transfer mechanism is arranged for rotating the driving shaft in a predetermined direction, regardless of the direction of rotation of the shaft coupling.

* * * * *